US010524971B2

(12) United States Patent
Davies et al.

(10) Patent No.: US 10,524,971 B2
(45) Date of Patent: Jan. 7, 2020

(54) LIFT CHAIR CONTROL DEVICE

(71) Applicant: Pride Mobility Products Corp., Exeter, PA (US)

(72) Inventors: Robert Williams Davies, Mountain Top, PA (US); Brett Alan Shoemaker, Mountain Top, PA (US)

(73) Assignee: Pride Mobility Products Corp., Exeter, PA (US)

( * ) Notice: Subject to any disclaimer, the term of this patent is extended or adjusted under 35 U.S.C. 154(b) by 0 days.

(21) Appl. No.: 16/180,608

(22) Filed: Nov. 5, 2018

(65) Prior Publication Data

US 2019/0091082 A1 Mar. 28, 2019

Related U.S. Application Data

(63) Continuation of application No. 15/557,118, filed as application No. PCT/US2016/021724 on Mar. 10, 2016, now Pat. No. 10,117,797.

(60) Provisional application No. 62/130,681, filed on Mar. 10, 2015.

(51) Int. Cl.

| | |
|---|---|
| ***A61G 5/14*** | (2006.01) |
| ***A47C 1/029*** | (2006.01) |
| ***A47C 1/035*** | (2006.01) |

(52) U.S. Cl.

CPC ..... *A61G 5/14* (2013.01); *A47C 1/029* (2013.01); *A47C 1/035* (2013.01); *A61G 2203/10* (2013.01)

(58) Field of Classification Search

CPC ..... A47G 5/14; A47C 1/029; A47C 1/035

USPC ..... 297/330

See application file for complete search history.

(56) References Cited

U.S. PATENT DOCUMENTS

| | | | | |
|---|---|---|---|---|
| 4,850,645 | A * | 7/1989 | Crockett | A61G 5/14 297/330 |
| 5,346,280 | A | 9/1994 | Deumite | |
| 5,467,002 | A * | 11/1995 | Brooks | A61G 15/02 297/330 |

(Continued)

FOREIGN PATENT DOCUMENTS

| | | |
|---|---|---|
| KR | 10-1107087 | 1/2012 |
| KR | 10-2014-0088757 | 7/2014 |

(Continued)

OTHER PUBLICATIONS

European Patent Application No. 16762490.7, Extended European Search Report, dated Aug. 13, 2018, 5 pages.

(Continued)

*Primary Examiner* — Syed A Islam

(74) *Attorney, Agent, or Firm* — Morgan, Lewis & Bockius LLP

(57) ABSTRACT

A lift chair comprising: a lift that transitions the lift chair between a resting position and a standing position; a user interface that receives one or more user inputs indicating a request to transition the lift chair between the resting position and the standing position; a controller circuit communicatively coupled to the lift and to the user interface, the controller circuit configured to cause the lift to transition the lift chair from the resting position to the standing position, in response to a single user input, at a first speed over a first time period followed by a second speed over a second time period, the first speed being slower than the second speed.

37 Claims, 5 Drawing Sheets

(56) References Cited

U.S. PATENT DOCUMENTS

| | | | | |
|---|---|---|---|---|
| 5,483,853 | A * | 1/1996 | Moradell | B60N 2/0228 74/665 GD |
| 5,513,867 | A | 5/1996 | Bloswick et al. | |
| 5,803,547 | A * | 9/1998 | Brown | A47C 3/18 297/217.1 |
| 5,931,532 | A * | 8/1999 | Kemmerer | A61G 5/14 297/325 |
| 6,623,077 | B1 * | 9/2003 | Piaulet | A47C 1/0242 297/330 |
| 6,678,601 | B2 * | 1/2004 | Whinnery | G05B 19/232 160/1 |
| 6,794,841 | B1 | 9/2004 | Vang et al. | |
| 7,152,922 | B2 * | 12/2006 | Garland | B60N 2/01583 297/362.11 |
| 9,351,890 | B2 * | 5/2016 | Hough | A61G 5/14 |
| 2005/0093353 | A1 | 5/2005 | Schussler et al. | |
| 2006/0076813 | A1 * | 4/2006 | Mohn | A61G 5/14 297/330 |
| 2011/0084529 | A1 * | 4/2011 | Huang | A61G 5/14 297/330 |
| 2012/0181832 | A1 * | 7/2012 | Lin | A61G 5/14 297/330 |
| 2014/0021760 | A1 | 1/2014 | Masters | |
| 2016/0058191 | A1 * | 3/2016 | Hegedus | A47C 7/506 297/330 |

FOREIGN PATENT DOCUMENTS

| | | |
|---|---|---|
| WO | 96/39895 | 12/1996 |
| WO | 2013/187819 | 12/2013 |

OTHER PUBLICATIONS

International Patent Application No. PCT/US2016/021724, Notification Concerning Transmittal of International Preliminary Report on Patentability (Chapter 1 of the Patent Cooperation Treaty), dated Sep. 21, 2017, 6 pages.

International Patent Application No. PCT/US2016/021724, Notification of Transmittal of the International Search Report and the Written Opinion of the International Searching Authority, or the Declaration, dated May 31, 2016, 7 pages.

* cited by examiner

Resting Position

Standing Position

LIFT CHAIR CONTROL DEVICE

CROSS REFERENCE TO RELATED APPLICATIONS

This application is a continuation application of U.S. patent application Ser. No. 15/557,118 filed Sept. 10, 2017, now U.S. Pat. No. 10,117,797, which is a U.S. National Stage filing of International Patent Application No. PCT/US2016/021724, entitled "LIFT CHAIR CONTROL DEVICE", filed on Mar. 10, 2016, which claims the benefit of U.S. Provisional Patent Application No. 62/130,681 filed Mar. 10, 2015 entitled "Lift Chart Control Device", all of which are incorporated by reference herein in their entireties.

FIELD OF THE INVENTION

The present invention generally relates to a lift chair that includes a control device and a method of operating a lift that transitions a chair between a resting position and a standing position.

BACKGROUND

For many people, it can be difficult to stand up from a chair. For example, the elderly and people with physical ailments or disabilities may not have the strength or coordination to properly lift themselves out of a chair. To address this problem, power operated lift chairs that transition from a resting position to a standing position may help people easily stand up.

Power operated lift chairs are necessarily configured to move the occupant of a chair in a safe manner. If a power operated lift chair cannot safely transition an occupant from a resting position to a standing position, then it could potentially harm the occupant. Also, a lift chair with a faster transition speed may startle an occupant as the chair aggressively begins transitioning to a standing position at too fast a rate. To improve safety and comfort, lift chairs generally operate at slow lifting speeds.

A slow lifting speed, however, can be trying to an occupant or present a problem for those that may need to exit the chair in a faster manner (e.g., in the event of an emergency, answering the telephone, or going to the restroom). For example, a slow lifting speed might force the occupant into a certain compromised standing position for a prolonged period of time while the chair transitions between positions. Therefore, there is a need to operate lift chairs faster in transition to a standing position that also provides a safe experience for the occupant.

SUMMARY

In one embodiment there is a lift chair comprising: a lift that transitions the lift chair between a resting position and a standing position; a user interface that receives one or more user inputs indicating a request to transition the lift chair between the resting position and the standing position; a controller circuit communicatively coupled to the lift and to the user interface, the controller circuit configured to cause the lift to transition the lift chair from the resting position to the standing position, in response to a single user input, at a first speed over a first time period followed by a second speed over a second time period, the first speed being slower than the second speed.

In a further embodiment, the lift transitions the lift chair from the resting position to the standing position at the first speed over the first time period in response to a first voltage of the electrical signal received from the controller circuit and at a second speed over the second time period in response to a second voltage of the electrical signal received from the controller circuit.

In a further embodiment, the first electrical signal has a voltage between 29 Volts (DC) and 38 Volts (DC) and the second electrical signal has a voltage characteristic of greater than approximately 40 Volts (DC).

In a further embodiment, the lift further comprises an actuator coupled to the lift that i) receives one or more electrical signals from the controller circuit and ii) causes lift to transition the lift chair from the resting position to the standing position at variable speeds that are proportional to the voltages of the one or more electrical signals received from the controller circuit.

In a further embodiment, the lift further comprises a structural assembly coupled between the actuator and the seat.

In a further embodiment, the controller circuit causes the lift to transition the lift chair from the resting position to the standing position at the first and second speeds when the lift chair receives power from a source other than a battery backup.

In a further embodiment, the first time period is between 0 and approximately 2 seconds.

In a further embodiment, the controller circuit includes: an enabling circuit configured to determine whether a first voltage of a first electrical signal received from the user interface is greater than a positive predetermined threshold; a voltage boost circuit in electrical communication with the enabling circuit and configured to generate a second electrical signal having a second voltage when the first voltage is greater than the positive predetermined threshold, the second voltage being greater than the first voltage; and a relay in electrical communication with the enabling circuit and the voltage boost circuit and configured to: i) transmit the first electrical signal having the first voltage to the actuator of a chair to cause the lift to begin transitioning the lift chair from the resting position to the standing position at the first speed during the first time period followed by the second electrical signal having the second voltage to the actuator to cause the lift to continuing transitioning the lift chair from the resting position to the standing position at the second speed during the second time period when the first voltage is greater than the positive predetermined threshold, ii) transmit the first electrical signal having the first voltage to the actuator to cause the lift to begin transitioning the lift chair from the resting position to the standing position when the first voltage is positive but less than the positive predetermined threshold and iii) transmit the first electrical signal having the first voltage to the actuator to cause the lift to begin transitioning the lift chair from the standing position to the resting position when the first voltage is negative.

In a further embodiment, the positive predetermined threshold is between 20 Volts (DC) and 38 Volts (DC).

In a further embodiment, the first voltage is between 29 Volts (DC) and 38 Volts (DC).

In a further embodiment, the first voltage is between 13 Volts and 20 Volts (DC).

In a further embodiment, the second voltage is greater than approximately 40 Volts.

In a further embodiment, the first time period is between 0 and approximately 2 seconds.

In a further embodiment, the first voltage is greater than the positive predetermined threshold when the first electrical signal is derived from a power source greater than a battery backup power source.

In a further embodiment, the first voltage is less than the positive predetermined threshold when the first electrical signal is derived from a battery backup power source.

In a further embodiment, the user interface is in electrical communication with a power source device and receives a positive voltage electrical signal and a negative voltage electrical signal from the power source device.

In a further embodiment, the user interface has a first user input component associated with a first user selection type and a second user input component associated with a second user selection type, wherein the first user selection type indicates that a user intends to transition the chair from resting position to a standing position and wherein the second user selection type indicates that a user intends to transition the chair from a standing position to a resting position.

In a further embodiment, the first electrical signal corresponds to the positive voltage electrical signal when the user interface device receives a first user selection type from the user and wherein the first electrical signal corresponds to the negative voltage electrical signal when the user interface device receives a second user selection type from the user.

In a further embodiment, the relay is configured to transmit the first electrical signal from the user interface device to the actuator when the voltage boost circuit discontinues normal operation.

In a further embodiment, the controller circuit includes a device protection component that absorbs a voltage of the first electrical signal when the first voltage is greater than a predefined safety threshold.

In a further embodiment, the controller circuit includes a device protection component that a voltage of the second electrical signal when the second voltage is greater than a predefined safety threshold.

In a further embodiment, the relay reduces a first current of the first electrical signal when the first current is greater than a predefined safety threshold.

In a further embodiment, the relay reduces a first current of the first electrical signal when the first current is greater than a predefined thermal safety threshold.

In a further embodiment, the lift chair further comprises a chair speed adjustment component in electrical communication with the relay and configured to adjust the second speed at which the actuator causes the lift to transition the lift chair from the resting position to the standing position or from the standing position to the resting position by adjusting the one or more voltages of the electrical signal transmitted from the transmitting component.

In one embodiment, there is a method of operating a lift that transitions a lift chair between a resting position and a standing position, the method comprising: receiving a first electrical signal having a first voltage from a user interface; determining whether the first voltage is greater than a positive predetermined threshold; generating a second electrical signal having a second voltage when the first voltage is greater than the positive predetermined threshold, the second voltage being greater than the first voltage; transmitting the first electrical signal to the actuator of a chair to cause the lift chair to transition from the resting position to the standing position at a first speed during a first time period followed by the second electrical signal to the actuator to cause the chair to transition the lift chair from the resting position to the standing position at the second speed during the second time period when the first voltage is greater than the positive predetermined threshold; and transmitting the first electrical signal to the actuator to cause the lift chair to transition from the standing position to the resting position or from the resting position to the standing position when the first voltage is less than the positive predetermined threshold.

In a further embodiment, the positive predetermined threshold is between 20 Volts (DC) and 38 Volts (DC).

In a further embodiment, the first voltage is between 20 Volts (DC) and 38 Volts (DC).

In a further embodiment, the first voltage is between 13 Volts (DC) and 20 Volts (DC).

In a further embodiment, the second voltage is greater than 40 Volts (DC).

In a further embodiment, the first time period is greater than approximately 2 seconds.

In a further embodiment, the first voltage is greater than the positive predetermined threshold when the first electrical signal is derived from a power source greater than a battery backup power source.

In a further embodiment, the first voltage is less than the positive predetermined threshold when the first electrical signal is derived from a battery backup power source.

In a further embodiment, the method further comprising: receiving a positive voltage electrical signal and a negative voltage electrical signal from the power source device.

In a further embodiment, the method further comprising: receiving, from the user, a first user selection type indicating that a user intends to transition the chair from a resting position to a standing position and corresponding the first electrical signal to the positive voltage electrical signal.

In a further embodiment, the method further comprising: receiving, from the user, a second user selection type indicating that a user intends to transition the chair from a standing position to a resting position and corresponding the first electrical signal to the negative voltage electrical signal.

In a further embodiment, the method further comprising: absorbing the voltage of the second electrical signal when the second voltage is greater than a predefined safety threshold.

In a further embodiment, the method further comprising: adjusting the second speed at which the actuator of a chair to cause the lift to transition the lift chair from the resting position to the standing position by adjusting the voltage of the second electrical signal.

BRIEF DESCRIPTION OF THE SEVERAL VIEWS OF THE DRAWINGS

The foregoing summary, as well as the following detailed description of embodiments of the invention, will be better understood when read in conjunction with the appended drawings of an exemplary embodiment. It should be understood, however, that the invention is not limited to the precise arrangements and instrumentalities shown.

In the drawings.

DETAILED DESCRIPTION

Figure 1A:
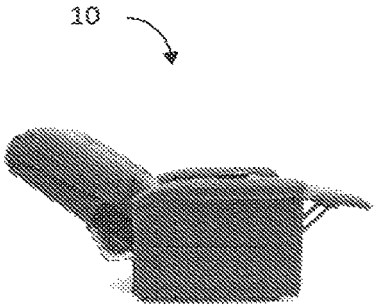
FIGS. 1A and 1B illustrate an exemplary chair in a resting position and a standing position, respectively, according to at least one embodiment of the invention.

To balance competing concerns between lift chairs with slow and fast transition speeds, a lift chair that gradually increases the transition speed during a transition may be more desirable. A lift chair with gradually increasing transition speeds might provide more safety and comfort to a user as compared to fast transition speeds because the user can comfortably adjust to each speed increase. It might also reduce frustration for an occupant by transitioning fast enough to avoid constraining occupants in uncomfortable positions for a prolonged period of time. As a result, a lift chair that gradually increases the transition speed might address problems in lift chairs with either slow or fast transition speeds.

Referring to the drawings in detail, wherein like reference numerals indicate like elements throughout, there is shown in FIGS. 1-5 a lift chair that includes a control device and a method of operating a lift that transitions a chair between a resting position and a standing position in accordance with exemplary embodiments of the invention.

I. Overall System

Figure 1B:
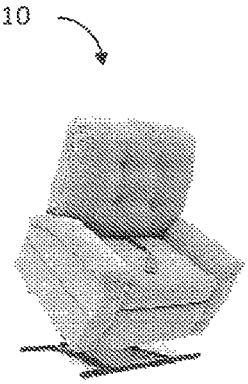

FIGS. 1A and 1B illustrates an exemplary chair 10 in a resting position and a standing position, respectively, according to at least one embodiment of the invention. A resting position for chair 10 may include for example, a traditional sitting or reclining position. A user's weight may be substantially bearing on chair 10 in normal use. And in some embodiments, a user would need to exert a substantial level of effort to stand from the lift chair, by for example, using one's arms to help push the user from the lift chair. The resting position may be any position other than a standing position, such as a reclined position, a sitting position or laying position, among others. A standing position for chair 10, for example, is a position that allows a user to be in a standing position with little or no support from chair 10. As will be explained in more detail below, chair 10 may transition between a resting position and a standing position at one or more speeds (e.g., a gradually increasing transition speed) based on the occurrence of one or more predetermined conditions (e.g., receiving power from an external power source).

Figure 2:
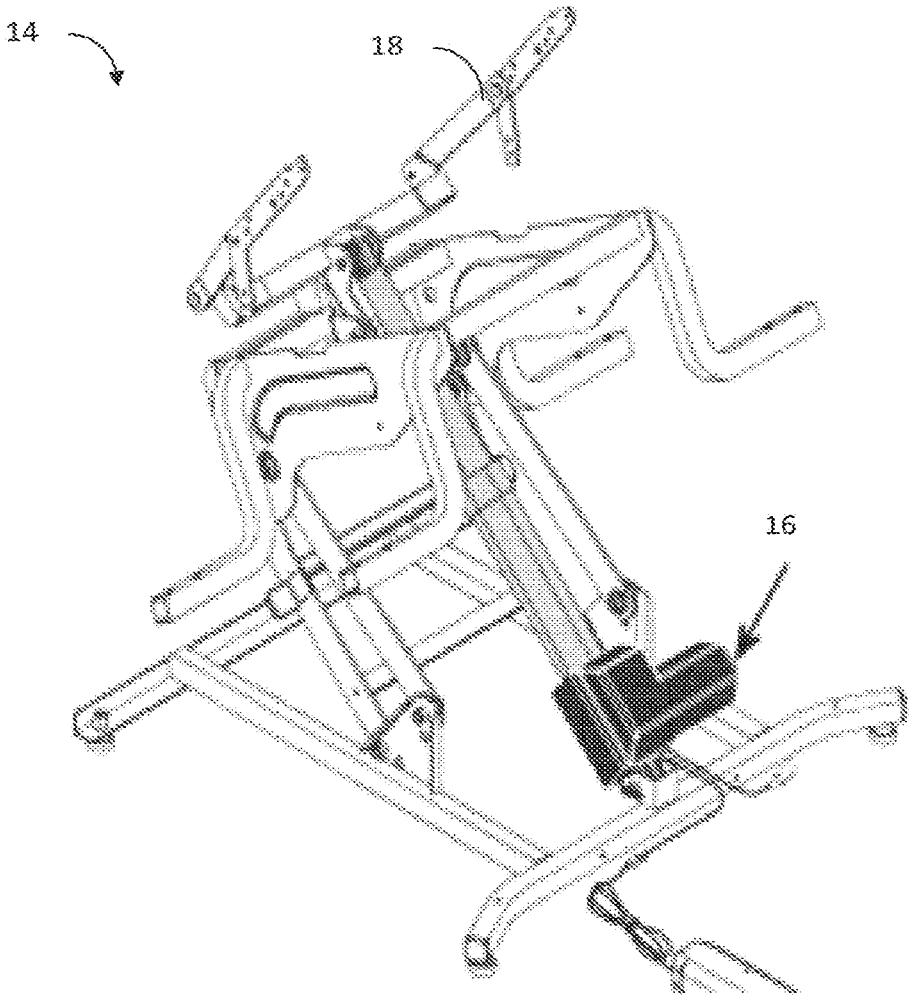
FIG. 2 is a perspective view of an exemplary lift of the chair according to at least one embodiment of the invention with the chair hidden for illustrative purposes.

FIG. 2 illustrates an exemplary lift 14 of chair 10 according to at least one embodiment of the invention with chair 10 hidden for illustrative purposes. In one embodiment, lift 14 may transition chair 10 between resting and standing positions. In one embodiment, as shown in FIG. 2, lift 14 may comprise actuator 16 and structural assembly 18 coupled between actuator 16 and chair 10.

In one embodiment, actuator 16 is any type of motor that can move structural assembly 18 in a manner that transitions chair 10 between positions based on certain characteristics of a received electrical signal. Actuator 16 moves structural assembly 18 by converting energy from the received electrical signal. The amount of energy in an electrical signal is based on certain characteristics of the electrical signal. As a result, certain characteristics of the received electrical signal will affect how the actuator 16 ultimately transitions chair 10.

Electrical signal characteristics that may be useful for controlling actuator 16 include voltage polarity and voltage amplitude. Voltage polarity of a received electrical signal may determine whether actuator 16 causes structural assembly 18 to transition chair 10 to a standing position or a resting position. For example, if the electrical signal has a positive voltage (e.g., +24 volts direct current ("DC")), then actuator 16 may cause structural assembly 18 to transition chair 10 from a resting position to a standing position. Alternatively, if the electrical signal has a negative voltage (e.g., −24 volts (DC)), then actuator 16 may cause structural assembly 18 to transition chair 10 from a standing position to a resting position. Voltage amplitude of a received electrical signal may determine a speed (e.g., a proportional speed, in one embodiment) at which actuator 16 moves structural assembly 18. For example, if the electrical signal has a voltage of +24 volts (DC), actuator 16 may cause structural assembly 18 to transition chair 10 from a resting position to a standing position at a first speed. Alternatively, if the electrical signal has a voltage of +48 volts (DC), actuator 16 may cause structural assembly 18 to transition chair 10 from a resting position to a standing position at a faster second speed (e.g., where a greater signal voltage results in a faster second speed). As a result, in some embodiment, voltage polarity and voltage amplitude are used to by actuator 16 to control positional transition of chair 10.

II. Control Device

Figure 3:
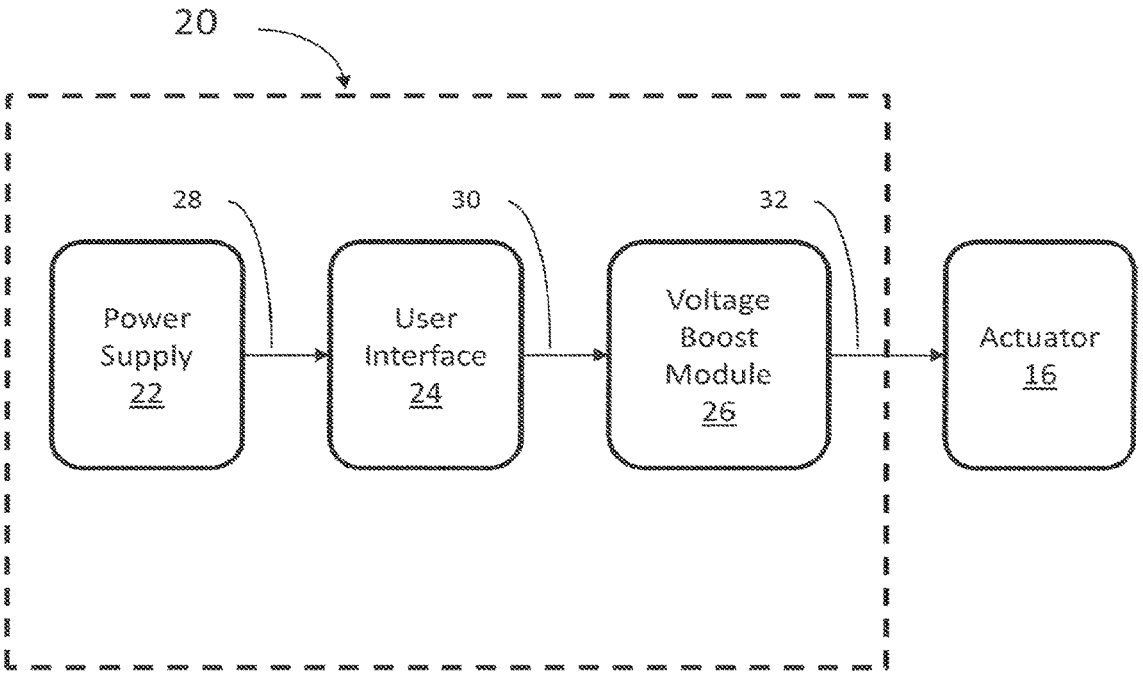
FIG. 3 is a schematic of an exemplary control device in electrical communication with actuator according, to at least one embodiment of the invention.

FIG. 3 is a schematic of an exemplary control device 20 in electrical communication with actuator 16 according to at least one embodiment of the invention. In this exemplary embodiment, control device 20 comprises a power supply 22, a user interface 24 and, a voltage boost module 26. Each of these components of control device 20 is explained in more detail below.

A. Power Supply

In one embodiment, power supply 22 is any device that converts an electrical power signal from a power source to another lift chair compatible electrical power signal. For example, power supply 22 may convert an electrical power signal received from an external power source (e.g., electrical power grid) to a power supply-provided ("PS") electrical signal 28 that can be used by actuator 16 to transition positions of chair 10. Alternatively, in cases where power supply 22 cannot receive power from an external power source, power supply 22 may convert an electrical power signal received from a battery backup to a PS electrical signal 28 that can also be used by actuator 16. Electrical power signals from an electrical power grid and a battery backup are just two examples of many different embodiments where power supply 22 converts an electrical power signal into a lift chair compatible electrical power signal (i.e., PS electrical signal 28).

Power supply 22 may supply a certain PS electrical signal 28 having certain voltages to user interface 24 based on whether a received electrical power signal is from an external power source (e.g., electrical power grid) or a battery backup. For example, power supply 22 may supply one or more PS electrical signals 28 having a positive or negative voltage with an absolute value of from 29 volts (DC) to 38 volts (DC), to user interface 24 when power supply 22 receives an electrical power signal from an external power source (e.g., electrical power grid). Alternatively, power supply 22 may supply one or more PS electrical signal 28 having a positive or negative voltage with an absolute value of from 13 volts DC to 20 volts DC, to user interface 24 when power supply 22 receives an electrical power signal that is indicative of a power signal from the battery backup (e.g., indicating that the external power source is unavailable) or an insufficient external power source (e.g., a power source that produces an electrical signal having a voltage amplitude less than 20 volts DC). Thus, availability of an electrical power signal from a sufficient external power source may be a factor in determining the voltage of PS electrical signal 28.

B. User Interface

In one embodiment, user interface 24 is any device that receives user inputs and transition chair 10 between positions, at different transition speeds based on the user inputs. In one embodiment, user interface 24 receives a PS electrical signal 28 from power supply 22, and generates a user interface-provided ("UI") electrical signal 30 with voltage polarities and/or voltage amplitudes based on one or more user inputs. In response to receiving a user input, user interface 24 transmits the UI electrical signal 30 to voltage boost module 26, and ultimately actuator 16, to transition chair 10 between positions at a user-selected speed. As a result, a user can control how chair 10 transitions positions using user interface 24.

User interface 24 may include one or more user-controllable components (e.g., push buttons, a switch, a potentiometer) that are configured to receive one or more user inputs. In one embodiment, user interface 24 may include one or more user-controllable components (e.g., "up" and "down" push buttons). In response to a selection of one or more user-controllable components, user interface 24 may generate and transmit a UI electrical signal 30 having a certain voltage polarity that controls the transition direction of chair 10. For example, user interface 24 may transmit a UI electrical signal 30 having a negative voltage polarity to voltage boost module 26 in response to receiving a user input to transition to a resting position (e.g. a first user selection type). Alternatively, user interface 24 may transmit a UI electrical signal 30 having a positive voltage polarity to voltage boost module 26 in response to receiving a user input to transition to a standing position (e.g., a second user selection type).

In another embodiment, user interface 24 may include one or more user-controllable components (e.g., a switch or potentiometer) having selectable positions that correspond to voltage amplitudes of UI electric signal 30. The selectable positions also correspond to a transition speed of chair 10. In one embodiment, a user may select a position that corresponds to one of the voltage amplitudes of UI electrical signal 30 and to a desired transition speed. In response to the user selection, user interface 24 delivers a UI electrical signal 30 with the certain voltage amplitude to voltage boost module 26.

C. Voltage Boost Module

In one embodiment, voltage boost module 26 is any device or controller circuit that controls transition speed of chair 10 via actuator 16 by transmitting different electrical signals (i.e., VBM electrical signals 32) having different voltage amplitudes to actuator 16. For example, by transmitting different electrical signals with increasing voltages to actuator 16 while chair 10 transitions to a standing position, voltage boost module 26 can cause actuator 16 to transition chair 10 to a standing position at a gradually increasing (e.g., step-wise) transition speed. A gradually increasing transition speed (e.g., a first initial speed during a first time period followed by a second faster speed during a second time period) for chair 10 can allow voltage boost module 26 to balance the safety concerns of a chair that transitions too fast, with the comfort concerns of a chair that transitions too slowly.

Also, voltage boost module 26 may be configured to only transmit electrical signals under one or more predetermined conditions. For example, transitioning chair positions at increased transition speeds may deplete a battery backup more quickly as compared to normal transition speeds. In addition, transitioning chair 10 to a resting position at increased transition speeds may cause discomfort for a user (e.g., dizziness from a quick decline to a resting position) or may introduce a crush hazard. Therefore, it may be preferable to only transition chair 10 at increased speeds when receiving power from an external power source other than a battery backup and/or when a user requests to transition chair 10 to a standing position. By only transitioning chair 10 at increasing speeds under one or more predetermined conditions, voltage boost module 26 can prolong battery life of a battery backup, providing a longer period of motorized lift functionality to an occupant and improve comfort for an occupant using chair 10.

Figure 4:
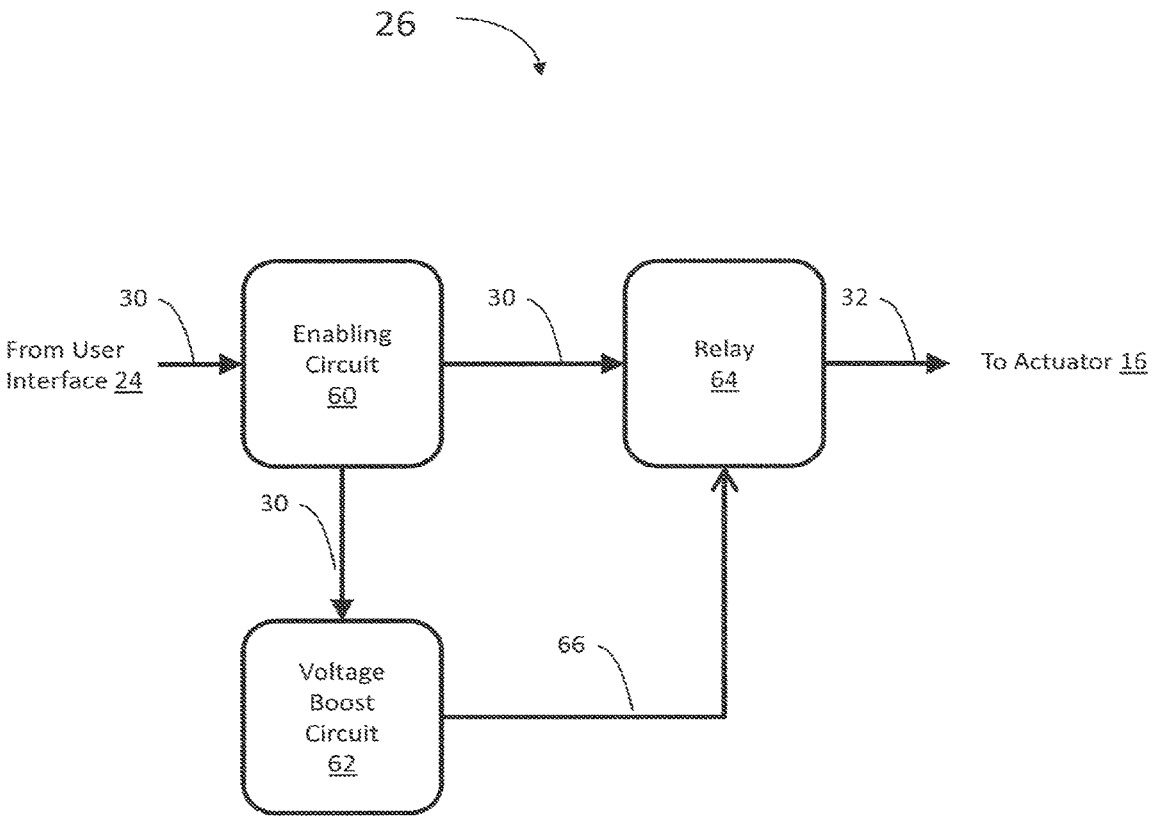
FIG. 4 is a component diagram of a voltage boost module according to at least one embodiment of the invention.
Figure 5:
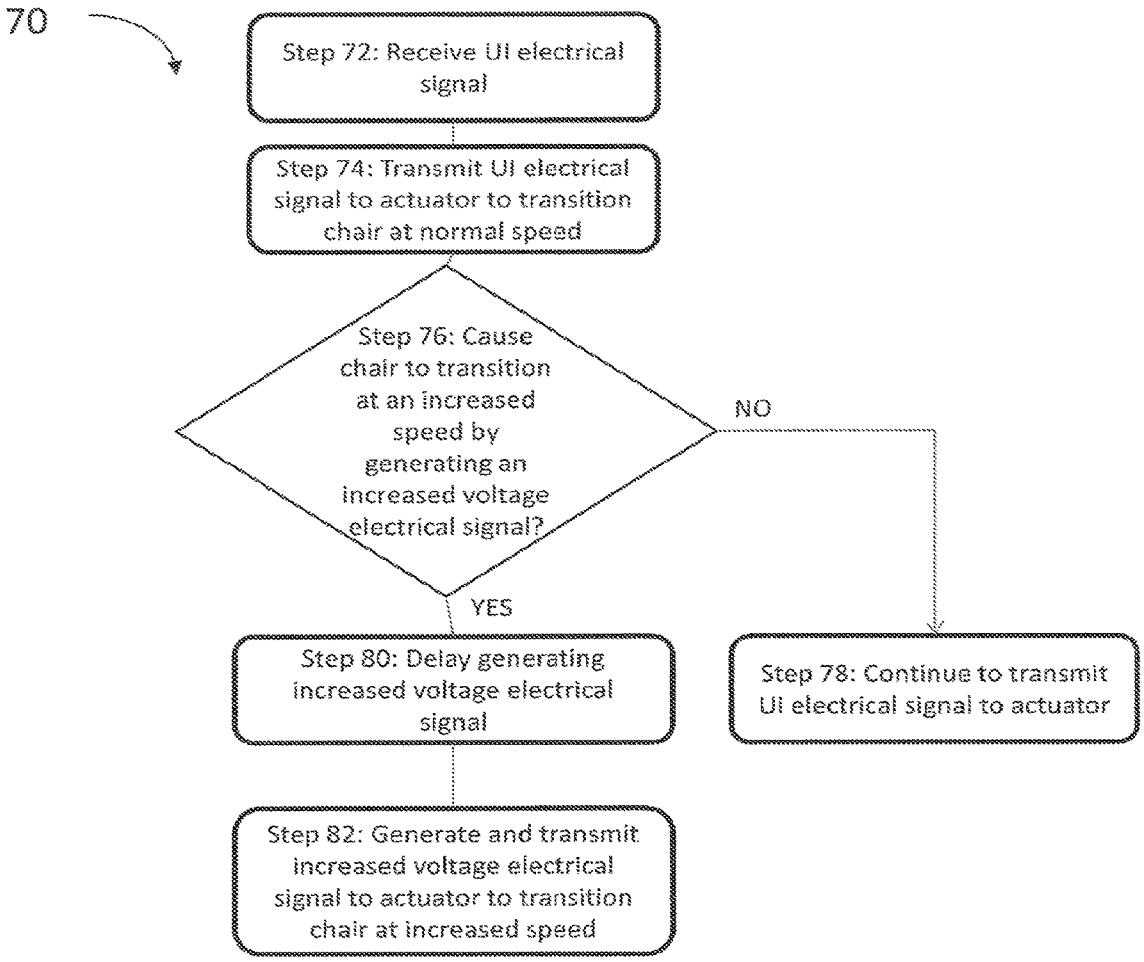
FIG. 5 is a flow chart describing a method of operating a lift that transitions a chair between a resting position and a standing position according to at least one embodiment of the invention.

FIGS. 4 and 5 illustrate embodiments in which different components of voltage boost module 26 cause actuator 16 to transition chair 10 to different position at different speeds based on one or more predetermined conditions. Specifically, FIG. 4 is a component diagram of a voltage boost module 26 according to at least one embodiment of the invention. In this embodiment, voltage boost module 26 includes enabling circuit 60, voltage boost circuit 62 and relay 64. In addition, FIG. 5 is a flow chart describing a method 70 of operating a lift that transitions a chair between a resting position and a standing position, using the components of FIG. 4, according to at least one embodiment of the invention.

At step 72, enabling circuit 60 receives a UI electrical signal 30 from user interface 24. In one embodiment, enabling circuit 60 is any device or circuit that determines whether to enable voltage boost circuit 62 to generate an increased voltage electrical signal to cause actuator 16 to transition chair 10 at increased speeds. Enabling circuit 60 determines whether to enable voltage boost circuit 62 based on voltage characteristics (e.g., voltage polarity, voltage amplitude) of the received UI electrical signal 30.

At step 74, enabling circuit 60 transmits UI electrical signal 30 to relay 64, which in turn will transmit UI electrical signal 30 to actuator 16 until relay 64 receives an increased voltage electrical signal. Relay 64 is any device or circuit that receives two input electrical signals and transmits one of those input electrical signals to actuator 16 upon the occurrence of a predetermined condition. For example, relay 64 may be a switch configured to transmit a UI electrical signal 30 as the VBM electrical signal 32 to actuator 16 until relay 64 receives the increased voltage electrical signal 66 from voltage boost circuit 62. Actuator 16 causes chair 10 to transition to a standing or resting position at a predetermined speed based on the voltage polarity and voltage amplitude of the UI electrical signal 30 while relay 64 is transmitting UI electrical signal 30 to actuator 16.

At step 76, enabling circuit 60 determines whether to enable voltage boost circuit 62 to generate an increased voltage electrical signal that causes actuator 16 to transition positions of chair 10 at an increased speed based on one or more conditions. For example, enabling circuit 60 determines whether to enable voltage boost circuit 62 based on i) the type of chair position request (e.g., to standing position, to resting, position) from a user and/or ii) the type of power source for chair 10. As stated above, it is preferable to transition chair 10 at increased speeds when a request to transition to a standing position is received and chair 10 receives power from a sufficient external power source.

Enabling circuit 60 determines the type of chair position request based on the voltage polarity of a received UI electrical signal 30. In one embodiment, enabling circuit 60 detects that the voltage polarity of the received UI electrical signal 30 is positive if user interface 24 received a request to transition chair 10 to a standing position. In one embodiment, enabling circuit 60 detects that the voltage polarity of the received UI electrical signal 30 is negative if user interface 24 received a request to transition chair 10 to a resting position.

Enabling circuit 60 determines the type of power source based on the voltage amplitude of a received UI electrical signal 30. In one embodiment, the power source for chair 10 is an external power source (e.g., power grid) that supplies a sufficient amount of voltage to boost UI electrical signal 30 if the voltage amplitude of the received UI electrical signal 30 exceeds a predetermined threshold. Alternatively, in one embodiment, enabling circuit 60 determines that the power source for chair 10 is a battery backup or an insufficient power source to boost UI electrical signal 30 if the voltage of the received UI electrical signal 30 does not exceed a predetermined threshold. Therefore, a UI electrical signal 30 that has a positive voltage polarity and a voltage amplitude that exceeds a positive predetermined threshold indicates a request to transition chair 10 to a standing position while chair 10 receives power from a sufficient external power source. As a result, in at least one embodiment, enabling circuit 60 will enable voltage boost circuit 62 to generate an increased voltage electrical signal because the voltage of received UI electrical signal 30 exceeds the positive predetermined threshold.

At step 78, if the voltage of received UI electrical signal 30 exceeds the positive predetermined threshold, enabling circuit 60 prevents the enablement of voltage boost circuit 62. Instead, relay 64 will continue to transmit the UI electrical signal 30 to actuator 16. Actuator 16 will cause chair 10 to complete transition to a standing or resting position based on the voltage polarity and voltage amplitude of the UI electrical signal 30.

At step 80, if the voltage of received UI electrical signal 30 exceeds a positive predetermined threshold, enabling circuit 60 delays generation of an increased voltage electrical signal by delaying enabling voltage boost circuit 62 for a first time period. In one embodiment, enabling circuit 60 includes one of: an RC time constant in a resister/capacitor circuit configuration, preset timer, or a microcontroller to set the delay. During this delay, as described in step 74, actuator 16 causes chair 10 to transition to a standing position at a speed based on the UI electrical signal 30 transmitted from relay 64. After the delay elapses, enabling circuit 60 enables voltage boost circuit 62 to generate an increased voltage electrical signal for actuator 16 that causes chair 10 to transition to a standing position at an increased speed for a second time period. The delay in generating and transmitting the increased voltage electrical signal causes chair 10 to transition to a standing position at a gradually increasing transition speed.

At step 82, after receiving an enable indication from enabling circuit 60, voltage boost circuit 62 generates an increased voltage electrical signal 66 (e.g., greater than approximately 40 volts DC). Voltage boost circuit 62 is any device or circuit that generates an increased voltage electrical signal 66 having an increased or stepped-up voltage as compared to a received electrical signal (e.g., UI electrical signal 30).

In some embodiments, voltage boost circuit 62 includes a synchronous rectifier to generate increased voltage electrical signal 66 from UI electrical signal 30. Synchronous rectification may be more desirable compared to other techniques for generating the increased voltage electrical signal 66 because synchronous rectification does not require any additional power consumption, thereby saving energy costs for the owner of chair 10. A DC-DC low quiescent current synchronous boost controller, such as TPS4306x controller, manufactured by TEXAS INSTRUMENTS®, is an example of a synchronous rectification device that may be included in voltage boost circuit 62.

After generating the increased voltage electrical signal 66, voltage boost circuit 62 transmits the increased voltage electrical signal 66 to relay 64. As explained above, relay 64 begins transmitting the increased voltage electrical signal 66 from voltage boost circuit 62 to actuator 16 as VBM electrical signal 32 after relay 64 receives increased voltage electrical signal 66. Actuator 16 causes chair 10 to transition to a standing position at an increased speed based on the increased voltage amplitude of the increased voltage electrical signal 66.

III. Additional Features

In some embodiments, chair 10 may include one or more chair speed adjustment components (e.g., a switch, a potentiometer) in electrical communication with relay 64 of voltage boost module 26. The chair adjustment components adjust the transition speed that chair 10 transitions to a standing position and/or a resting position in response to a user input. The chair speed adjustment component may adjust the transition speed by increasing, or decreasing the voltage amplitude of VBM electrical signal 32 transmitted from relay 64. In some embodiments, chair 10 may include first and second chair speed adjustment components. The first and second chair speed adjustment components transition chair 10 to a standing position at a first speed and a resting position at a second speed that is different than the first speed in response to a user input. Thus, the one or more chair speed adjustment components cause chair 10 to transition at different speeds when transitioning to a standing position and/or resting position based on user preference.

In some embodiments, voltage boost module 26 may include device protection components in the event that chair 10 does not function correctly. For example, device protection components may be transient voltage suppression diodes that may absorb excess voltage of VBM electrical signal 32 when the voltage is greater than a predefined safety threshold indicating an overvoltage failure condition. In addition, the transient voltage suppression diodes may shunt (i.e., reduce) excess current of the VBM electrical signal 32 if the current exceeds a predefined safety threshold indicating an overcurrent failure condition. Moreover, the transient voltage suppression diodes may shunt (i.e., reduce) excess current of the VBM electrical signal 32 if the current exceeds a predefined thermal safety threshold indicating overheating of control device 20 or actuator 16. The transient voltage suppression diodes may reset after the excess current or excess voltage event is reduced or absorbed, respectively. Thus, device protection components such as transient voltage suppression diodes may allow chair 10 to function correctly even when other components fail.

In at least one embodiment, there is included one or more computers having one or more processors and memory (e.g., one or more nonvolatile storage devices). In some embodiments, memory or computer readable storage medium of memory stores programs, modules and data structures, or a subset thereof for a processor to control and run the various systems and methods disclosed herein. In one embodiment, a non-transitory computer readable storage medium having stored thereon computer-executable instructions which, when executed by a processor, perform one or more of the methods disclosed herein.

It will be appreciated by those skilled in the art that changes could be made to the exemplary embodiments shown and described above without departing from the broad inventive concept thereof. Headings contained in the written description above are intended to facility a review of the written description and not to impact the scope of the claims. Moreover, this invention is not limited to the exemplary embodiments shown and described, but it is intended to cover modifications within the spirit and scope of the present invention as defined by the claims. For example, specific features of the exemplary embodiments may or may not be part of the claimed invention and features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the method does not rely on the particular order of steps set forth herein, the particular order of the steps should not be construed as limitation on the claims. The claims directed to the method of the present invention should not be limited to the performance of their steps in the order written, and one skilled in the art can readily appreciate that the steps may be varied and still remain within the spirit and scope of the present invention.

What is claimed is:

1. A lift chair comprising:

a lift that transitions the lift chair between a resting position and a standing position;

a user interface that receives one or more user inputs indicating a request to transition the lift chair between the resting position and the standing position;

a controller circuit communicatively coupled to the lift and to the user interface, the controller circuit configured to cause the lift to transition the lift chair from the resting position to the standing position, in response to a single user input, at a first speed over a first time period followed by a second speed over a second time period, the first speed being slower than the second speed.

2. The lift chart of claim 1, wherein the lift transitions the lift chair from the resting position to the standing position at the first speed over the first time period in response to a first voltage of the electrical signal received from the controller circuit and at a second speed over the second time period in response to a second voltage of the electrical signal received from the controller circuit.

3. The lift chair of claim 2, wherein the first electrical signal has a voltage between 29 Volts (DC) and 38 Volts (DC) and the second electrical signal has a voltage characteristic of greater than approximately 40 Volts (DC).

4. The lift chair of claim 2, wherein the lift further comprises an actuator coupled to the lift that i) receives one or more electrical signals from the controller circuit and ii) causes the lift to transition the lift chair from the resting position to the standing position at variable speeds that are proportional to the voltages of the one or more electrical signals received from the controller circuit.

5. The lift chair of claim 4, wherein the lift further comprises a structural assembly coupled between the actuator and the seat.

6. The lift chair of claim 2, wherein the controller circuit causes the lift to transition the lift chair from the resting position to the standing position at the first and second speeds when the lift chair receives power from a source other than a battery backup.

7. The lift chair of claim 2, wherein the first time period is between 0 seconds and approximately 2 seconds.

8. The lift chair of claim 1, wherein the controller circuit includes:

an enabling circuit configured to determine whether a first voltage of a first electrical signal received from the user interface is greater than a positive predetermined threshold;

a voltage boost circuit in electrical communication with the enabling circuit and configured to generate a second electrical signal having a second voltage when the first voltage is greater than the positive predetermined threshold, the second voltage being greater than the first voltage; and a relay in electrical communication with the enabling circuit and the voltage boost circuit and configured to: i) transmit the first electrical signal having the first voltage to the actuator of a chair to cause the lift to begin transitioning the lift chair from the resting position to the standing position at the first speed during the first time period followed by the second electrical signal having the second voltage to the actuator to cause the lift to continuing transitioning the lift chair from the resting position to the standing position at the second speed during the second time period when the first voltage is greater than the positive predetermined threshold, ii) transmit the first electrical signal having the first voltage to the actuator to cause the lift to begin transitioning the lift chair from the resting position to the standing position when the first voltage is positive but less than the positive predetermined threshold and iii) transmit the first electrical signal having the first voltage to the actuator to cause the lift to begin transitioning the lift chair from the standing position to the resting position when the first voltage is negative.

9. The lift chair of claim 8, wherein the positive predetermined threshold is between 20 Volts (DC) and 38 Volts (DC).

10. The lift chair of claim 8, wherein the first voltage is between 20 Volts (DC) and 38 Volts (DC).

11. The lift chair of claim 8, wherein the first voltage is between 13 Volts (DC) and 20 Volts (DC).

12. The lift chair of claim 8, wherein the second voltage is greater than approximately 40 Volts (DC).

13. The lift chair of claim 8, wherein the first time period is between 0 seconds and approximately 2 seconds.

14. The lift chair of claim 8, wherein the first voltage is greater than the positive predetermined threshold when the first electrical signal is derived from a power source greater than a battery backup power source.

15. The lift chair of claim 8, wherein the first voltage is less than the positive predetermined threshold when the first electrical signal is derived from a battery backup power source.

16. The lift chair of claim 8, wherein the user interface is in electrical communication with a power source device and receives a positive voltage electrical signal and a negative voltage electrical signal from the power source device.

17. The lift chair of claim 16, wherein the user interface has a first user input component associated with a first user selection type and a second user input component associated with a second user selection type, wherein the first user selection type indicates that a user intends to transition the chair from the resting position to the standing position and wherein the second user selection type indicates that a user intends to transition the chair from the standing position to the resting position.

18. The lift chair of claim 17, wherein the first electrical signal corresponds to the positive voltage electrical signal when the user interface device receives a first user selection type from the user and wherein the first electrical signal corresponds to the negative voltage electrical signal when the user interface device receives a second user selection type from the user.

19. The lift chair of claim 8, wherein the relay is configured to transmit the first electrical signal from the user interface device to the actuator when the voltage boost circuit discontinues normal operation.

20. The lift chair of claim 8, wherein the controller circuit includes a device protection component that absorbs a voltage of the first electrical signal when the first voltage is greater than a predefined safety threshold.

21. The lift chair of claim 8, wherein the controller circuit includes a device protection component that absorbs a voltage of the second electrical signal when the second voltage is greater than a predefined safety threshold.

22. The lift chair of claim 8, wherein the relay reduces a first current of the first electrical signal when the first current is greater than a predefined thermal safety threshold.

23. The lift chair of claim 8, wherein the relay reduces a first current of the first electrical signal when the first current is greater than a predefined safety threshold.

24. The lift chair of claim 8, further comprising:

a chair speed adjustment component in electrical communication with the relay and configured to adjust the second speed at which the actuator causes the lift to transition the lift chair from the resting position to the standing position or from the standing position to the resting position by adjusting the one or more voltages of the electrical signal transmitted from the transmitting component.

25. A method of operating a lift that transitions a lift chair between a resting position and a standing position, the method comprising:

receiving a first electrical signal having a first voltage from a user interface;

determining whether the first voltage is greater than a positive predetermined threshold;

generating a second electrical signal having a second voltage when the first voltage is greater than the positive predetermined threshold, the second voltage being greater than the first voltage;

transmitting the first electrical signal to an actuator of a chair to cause the lift to transition the lift chair from the resting position to the standing position at a first speed during a first time period followed by the second electrical signal to the actuator to cause the lift to transition the lift chair from the resting position to the standing position at a second speed during the second time period, in response to a single user input, when the first voltage is greater than the positive predetermined threshold; and transmitting the first electrical signal to the actuator to cause the lift to transition the lift chair from the standing position to the resting position or from the resting position to the standing position when the first voltage is less than the positive predetermined threshold.

26. The method of claim 25, wherein the positive predetermined threshold is between 20 Volts (DC) and 38 Volts (DC).

27. The method of claim 25, wherein the first voltage is between 29 Volts (DC) and 38 Volts (DC).

28. The method of claim 25, wherein the first voltage is between 13 Volts (DC) and 20 Volts (DC).

29. The method of claim 25, wherein the second voltage is greater than approximately 40 Volts (DC).

30. The method of claim 25, wherein the first time period is greater than approximately 2 seconds.

31. The method of claim 25, wherein the first voltage is greater than the positive predetermined threshold when the first electrical signal is derived from a power source greater than a battery backup power source.

32. The method of claim 25, wherein the first voltage is less than the positive predetermined threshold when the first electrical signal is derived from a battery backup power source.

33. The method of claim 25, further comprising:

receiving a positive voltage electrical signal and a negative voltage electrical signal from the power source device.

34. The method of claim 33, further comprising:

receiving, from the user, a first user selection type indicating that a user intends to transition the chair from the resting position to the standing position and corresponding the first electrical signal to the positive voltage electrical signal.

35. The method of claim 34, further comprising:

receiving, from the user, a second user selection type indicating that a user intends to transition the chair from a standing position to a resting position and corresponding the first electrical signal to the negative voltage electrical signal.

36. The method of claim 25, further comprising:

absorbing the voltage of the second electrical signal when the second voltage is greater than a predefined safety threshold.

37. The method of claim 25, further comprising: adjusting the second speed at which the actuator of the chair causes the lift to transition the lift chair from the resting position to the standing position by adjusting the voltage of the second electrical signal.

* * * * *